US008359669B2

(12) United States Patent
Tonegawa

(10) Patent No.: US 8,359,669 B2
(45) Date of Patent: Jan. 29, 2013

(54) FACE MASK

(76) Inventor: Daichi Tonegawa, Kitamoto (JP)

( * ) Notice: Subject to any disclaimer, the term of this patent is extended or adjusted under 35 U.S.C. 154(b) by 327 days.

(21) Appl. No.: 12/449,986

(22) PCT Filed: Mar. 7, 2008

(86) PCT No.: PCT/JP2008/054182
§ 371 (c)(1),
(2), (4) Date: May 14, 2010

(87) PCT Pub. No.: WO2008/108464
PCT Pub. Date: Sep. 12, 2008

(65) Prior Publication Data

US 2010/0218304 A1 Sep. 2, 2010

(30) Foreign Application Priority Data

Mar. 8, 2007 (JP) ..... 2007-058604

(51) Int. Cl.
*A42B 1/18* (2006.01)

(52) U.S. Cl. ..... 2/206

(58) Field of Classification Search ..... 2/171, 200.1, 2/174, 207, 909, 173, 209.11, 202, 204, 206, 2/203, 9, 468, 424, 208; 128/206.16, 206.21, 128/206.24, 206.28
See application file for complete search history.

(56) References Cited

U.S. PATENT DOCUMENTS

| | | | | | |
|---|---|---|---|---|---|
| 2,056,753 | A * | 10/1936 | Wagner | 128/206.19 |
| 2,634,725 | A * | 4/1953 | Lo Presti | 128/206.19 |
| 4,300,240 | A * | 11/1981 | Edwards | 2/206 |
| 4,641,379 | A * | 2/1987 | Martin | 2/9 |
| 4,825,474 | A * | 5/1989 | Edwards | 2/206 |
| 5,035,006 | A * | 7/1991 | Hetz et al. | 2/209.11 |
| 5,214,804 | A * | 6/1993 | Carey et al. | 2/206 |
| 5,704,063 | A * | 1/1998 | Tilden | 2/9 |
| 2006/0085881 | A1 * | 4/2006 | Gellis et al. | 2/9 |
| 2011/0179540 | A1 * | 7/2011 | Sutton | 2/9 |

FOREIGN PATENT DOCUMENTS

| | | |
|---|---|---|
| JP | Y1-3-3770 | 4/1928 |
| JP | U-58-151615 | 10/1983 |
| JP | U-62-175037 | 11/1987 |
| JP | U-3017137 | 8/1995 |
| JP | A-8-81807 | 3/1996 |
| JP | A-8-89616 | 4/1996 |
| JP | A-10-110306 | 4/1998 |
| JP | A-2006-316362 | 11/2006 |

OTHER PUBLICATIONS

International Search Report mailed on May 1, 2008 in corresponding International Application No. PCT/JP2008/054182.

* cited by examiner

*Primary Examiner* — Amy Vanatta
(74) *Attorney, Agent, or Firm* — Oliff & Berridge, PLC

(57) ABSTRACT

A face mask includes a first cloth-like piece, a pair of second cloth-like pieces, a pair of connecting piece for connecting the first and second cloth-like pieces, and an upper edge member for comfortable use and restricting excessive extension. The first cloth-like piece covers from beneath a nose to jaw of user's head. The second cloth-like pieces extends from cheeks to a back of the head. The connecting pieces are elastically stretchable. Each of the second cloth-like pieces has a leading portion for mutual connection at the back of the user's head. The first and second cloth-like pieces are hard to stretch elastically than the connecting pieces. The upper edge member extends from the connecting piece to adjacent parts of the first and second cloth-like pieces, the said upper edge member is hard to stretch elastically than the connecting pieces.

3 Claims, 4 Drawing Sheets

FACE MASK

FIELD OF THE INVENTION

The present invention relates to a face mask.

BACKGROUND

For use in skiing and snowboarding, there is a known cold-resistant mask having a front piece for covering from beneath the eye to the jaw and a pair of elastically stretchable band-shaped pieces extending from the left and right ends of the front piece. Each band-shaped piece has a leading portion with a fastener for mutual linkage at the back a user's head (Patent Document 1).

The front piece has a fixed form plate for keeping a breath passage, since if the front piece were made of elastic cloth only, it would prevent easy breathing.

[Patent Document 1] Patent Laid-Open h08-89616
[Patent Document 2] Patent Laid-Open h10-110306
[Patent Document 3] Patent Laid-Open 2006-316362
[Patent Document 4] Patent Laid-Open h08-081807

SUMMARY OF THE INVENTION

However, the face mask according to the Patent Document 1 has following problems.

Firstly, it is difficult to fold the face mask for storage as ordinary cloth goods, since the front piece of the mask is provided with the fixed form plate.

Secondly, when the band-shaped piece loses tension due to repeated use, the face mask slackens with the fastener being linked mutually.

Thirdly, as the face mask except its front piece is made of elastic cloth, which becomes thin by extension, it deteriorates its cold-resistant function.

The present applicant has studied how to solve these problems. In other technical field, it is known to divide cloth material for trousers into several parts, such as a front part and a rear part, and to reconnect these parts by elastically stretchable cloth-like material. See Patent Document 2. By way of trial, the applicant has divided a conventional face mask into three parts, a front portion and a pair of side portions extending to the wearer's occiput. And the front portion is connected to the side portions by elastic cloths. In this configuration, its extension concentrates on the elastic cloths, which would lose tension due to repeated use, such that the face mask may slacken.

An attention is directed to a member for protecting an edge of a cloth, which is called an edge member. One of the edge member known in the art is a bias tape. See Patent Document 3. The bias tape is made by cutting a cloth obliquely against the direction of the fiber of its own. Such bias tape is somewhat stretchable elastically to its longwise direction. In an initial trial, the applicant has applied the bias tape in its normal usage to protect the periphery (or rim) of the front portion and those of the side portions respectively. However, the applicant has found useful to apply the edge member from one end of the elastic cloth to adjacent ends of the front portions and the side portions running in a line with the one end. Due to this, the elastic cloth is restricted from its extension near the edge member, but is free from such restriction at a side distal from the edge member. This face mask stretches comfortably for the wearer, but is free from excessive extension due to the repeated use.

The object of the present invention is to provide a face mask which is comfortable to use and free from slackening due to repeated use. The face mask is divided into several parts, which are connected by stretchable connecting portions, and an edge member for restricting its stretching.

In accordance with a first aspect of the present invention, a face mask comprising;

a first cloth-like piece which is soft and adapted to cover at least from beneath a nose to a jaw of a user's head, a pair of second cloth-like pieces which are soft and adapted to extend from cheeks to a back of the user's head, a pair of cloth-like connecting pieces which are soft and elastically stretchable for connecting both left and right sides of the first cloth-like piece and corresponding ends of the second cloth-like pieces.

Each of the second cloth-like pieces has a leading portion for mutual connection at the back of the user's head.

The face mask is characterized in that the first cloth-like piece and the second cloth-like pieces are harder to stretch elastically than the connecting pieces. Moreover the face mask is further provided at its upper end with an upper edge member extending from the connecting piece to at least adjacent parts of the first cloth-like piece and the second cloth-like pieces. The upper edge member is harder to stretch elastically than the connecting pieces.

In the face mask according to the first aspect, the several portions of the main body are reconnected by stretchable connecting portions and a less-stretchable edge member. Patent document 4 indicates the combination of stretchable and less-stretchable materials in clothes. However, it teaches a stretchable sportswear with a rigid line extending along a sleeve or trouser for limiting the expansion of muscle for prevention of wearer's physical trouble. On the other hand, the present invention prevents the connecting portion from deterioration due to excessive extension.

The edge member for limiting extension of the connecting piece is located at the upper ends of the connecting piece and the first and second cloth-like pieces. This is because the upper side of the face mask is tensioned by touching the face, when the mask covers the lower half of the face with its ends being tied at back of the head. But the edge members may be made on both upper and lower sides. The words "upper", "lower", "right" and "left" indicate each direction of the mask when the user wear it. The word "cloth-like" means to thin, flexible and spreadable as a cloth, and is not limited to cloth itself.

The face mask means one for covering a face, such as a cold-resistant mask preferably but may be a dust-proofing mask or deodorant mask for example.

The cloth-like piece is a portion of the main body of the face mask. For example, the mask of reversed triangle, or laterally long rectangle may be divided into a front portion (first cloth-like piece), and a pair of side portions (second cloth-like pieces). The first cloth-like piece may reach above the nose.

The connecting piece connects the first and second cloth-like pieces. The connecting piece is at least stretchable, but also preferably contractible made of elastic material such as polyurethane resin or polyether ester resin.

The upper edge member is formed at least a part of the upper side of the face mask corresponding the upper edge of the connecting piece and adjacent upper end portion of the cloth-like pieces to restrict the excessive extension of the connecting piece. The upper edge member may be less-stretchable elastic material such as the bias tape, or un-stretchable material. The bias tape is cut obliquely against the direction of its fiber (preferably at 45 degree). The oblique angle may be changed to vary its stretchability.

For example, the connecting piece may be made of the elastic material such as polyester resin, and the upper edge member may be made of a hemming tape with less stretchability which is cut perpendicular or in parallel with the direction of the fiber. In this specification, less-stretchable material means that its degree of stretching is small relative to tension.

In conclusion of the first aspect, the face mask is easy to manufacture and is folded easily for storage, since it is formed by connecting the first cloth-like piece with second cloth-like pieces by the elastically stretchable connecting piece. Moreover, the upper edge member prevents the connecting piece from slackening due to repeated use by restricting excessive extension. The upper edge member ranges from the upper end of the connecting piece to the adjacent upper end portions of the first and second cloth-like pieces.

In accordance with a second aspect of the present invention, a face mask includes all the feature mentioned in the first aspect, and is characterized in that the face mask has an upper side which is defined by respective upper ends of the first cloth-like piece and the connecting pieces and the second plate-like pieces, and the upper side is straight or gently arched.

The upper edge member extends continuously along the upper side to function as a fastening band for putting the face mask on a user's face.

The second aspect proposes the upper edge member extending the entire upper side of the face mask as a fastening band for wearing the face mask. As the upper edge member is less stretchable, the cloth-like piece under the fastening band loosens, so that the wearer can breath and speak at ease.

In conclusion of the second aspect, the wearer can breath and speak at ease. This is because the upper edge member extends continuously from the first cloth-like piece through the connecting pieces to the second cloth-like pieces at their upper ends as a fastening band. The face mask tightens the wearer's face mainly at the vicinity of the fastening band, below which the first and second cloth-like pieces loosens.

In accordance with a third aspect of the present invention, a face mask includes all the feature mentioned in the first aspect, and is characterized in that the face mask has an upper side which is defined by respective upper ends of the first cloth-like piece and the connecting pieces and the second plate-like pieces, and the upper side is as a whole straight or gently arched, but curved downwardly around the first cloth-like piece to form a recessed part when the face mask is attached to the user's head.

The face mask further comprises a spanning linear member which is provided between both ends of the recessed part also serving as an edge of the mask, and a third cloth-like piece which is depending from the spanning linear member over the first cloth-like piece so as to cover the recessed part.

The recessed part is so sized that a mouth of the user appears in the recessed part when the spanning linear member rests on the nose of the user and the third cloth-like piece is turned over.

And moreover, the upper edge element ranges over the respective upper ends of the first and second cloth-like pieces and the connecting piece, such that a portion of the upper edge member excluding the depressed part and the spanning linear member function as a single suspension band for putting on a user's face.

The third aspect proposes the face mask comprising the first and second cloth-like pieces and also the third cloth-like piece for covering the mouth of the user, such that the mouth is exposed to the outside by turning over the third cloth-like piece. Conventionally, the user should remove the face mask as a whole for drinking for example in skiing area. The user is troubled in removing but also feels chill. The third aspect is advantageous in such cases. The recessed part may be formed at the first cloth-like piece only, but it may extend more widely from the first cloth-like piece to the connecting piece for example.

In conclusion of the third aspect, the mouth can be exposed for drinking and eating by turning the third cloth-like piece covering it, while keeping warm at other than mouth. This is due to downward recession of the outline of the first and second cloth-like pieces and connecting pieces around the first cloth-like piece. The wearer can breath and speak at ease, since the portion of the upper edge member except the recessed part and the spanning linear member bridging over the recessed part function as the fastening band. The face mask tightens the wearer's head at its side near the fastening band, such that the first and second cloth-like pieces loosen at the other side.

EXPLANATION ON NUMERAL

Figure 1:
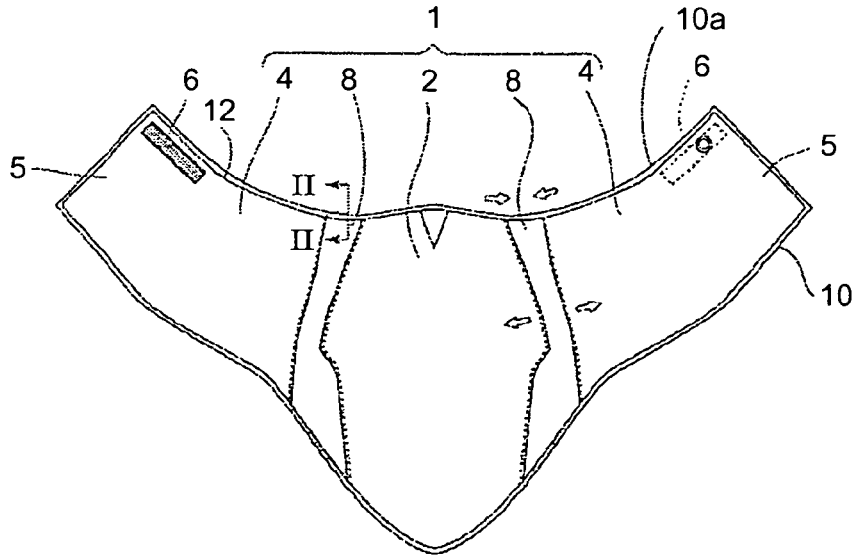
FIG. 1 shows a front side view of a face mask according to first embodiment of the present invention.

1 . . . main mask body
2 . . . first cloth-like piece
4 . . . second cloth-like pieces
5 . . . a leading portion
6 . . . fastener
8 . . . connecting piece
10 . . . edge member
12 . . . upper side
16 . . . third cloth-like piece
18 . . . recessed part
20 . . . spanning linear member

BEST EMBODIMENT OF THE INVENTION

Figure 2:
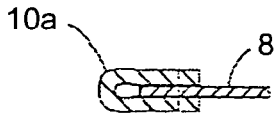
FIG. 2 shows a partial sectional view of the face mask shown in FIG. 1.
Figure 3:
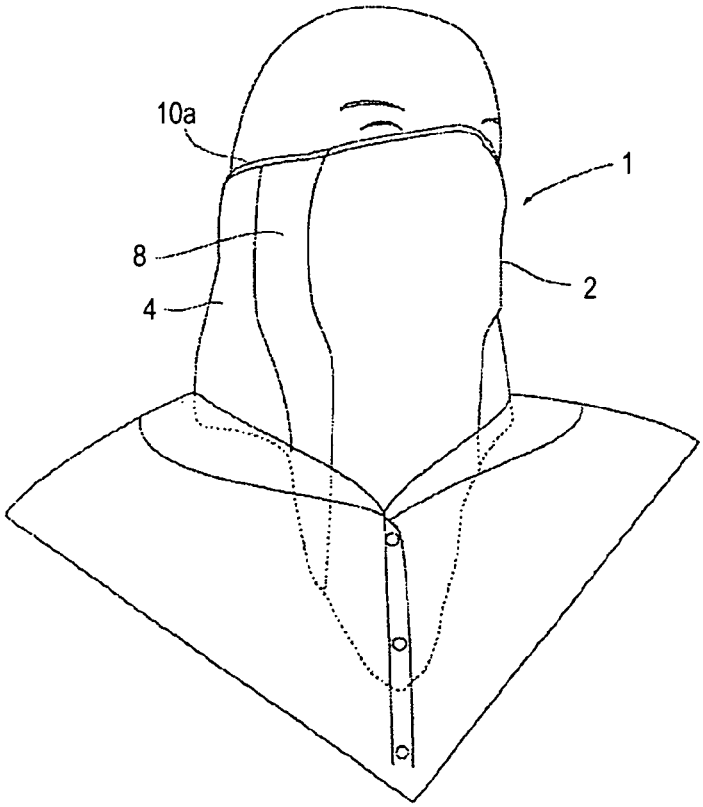
FIG. 3 shows how to use the face mask shown in FIG. 1.

FIGS. 1 to 3 show the first embodiment of a face mask according to the first embodiment.

This face mask comprises a main mask body 1 and an edge member 10.

The main mask body 1 comprises a first cloth-like piece 2 and second cloth-like pieces 4 and connecting pieces 8.

The first cloth-like piece 2 is so long that it extends from the user's nose through the mouth and jaws to the breast. This shape is useful because the lower portion of the first cloth-like piece is folded into the collars of the clothes as shown in FIG. 3 to keep warm. But the first cloth-like piece may be sized to cover the mouth only or to cover the mouth and nose.

The second cloth-like pieces 4, each having a leading portion 5, are long enough to reach from the cheeks to back of the head and have fasteners 6 at front side of one of the leading portions 5 and rear side of the other.

In a favorable embodiment, first cloth-like piece 2 and second cloth-like piece 4 may be respectively made of a facing fabric such as wool, and a lining fabric such as polyester resin with a less sticky feeling.

Each connecting piece 8 connects the first cloth-like piece 2 and the second cloth-like piece 4. In one embodiment, each connecting piece 8 has a leading end portion which is inserted into between the facing fabric and lining fabric of the cloth-like piece and sewed thereto, such that the connecting piece 8 continues to the first and second cloth-like pieces 2, 4. The connecting piece 8 may be elastically stretchable such as polyester resin.

The edge member 10 is provided along the whole periphery of the main mask body 1. The edge member may be made of a band-shaped material which is bent to have an U-shaped section as shown in FIG. 2 into which the end of the cloth-like piece or the connecting piece is inserted and sewed thereto. The edge member includes an upper edge member 10*a* which is attached to an upper side 12 of the mask main body. The upper edge member is a fastening band which plays an important role in putting the face mask on the user's face. At the least, the upper edge member 10*a* is less-stretchable than the connecting piece 8.

In a manner of use, the first cloth-like piece 2 covers the nose hole and mouth, when the user grasps the leading portion 5 of the second cloth-like piece 4 to rest the upper edge member 10*a* on the nose tip. The mask is put on one's face by turning the leading portions 5, 5 with the fasteners 6,6 toward the back of user's head for mutual linkage. The upper edge member 10*a* extends from the nose tip through cheek to the fasteners and is strained as a single fastening band, so that the upper end portion of the face mask fits firmly to the face. But the face mask except its upper end portion covers the lower half of the face loosely. This ensures easy breathing. Since the connecting piece stretches moderately at its part distant from upper edge member 10*a*, the face mask curves in accord with the recessions and the projections on the face. The upper edge member 10*a* limits the excessive extension of the face mask at its vicinity to overcome slackening.

Hereinafter, other embodiments of the present invention are explained. The explanation is omitted on the configuration which is identical to that of the first embodiment.

Figure 4:
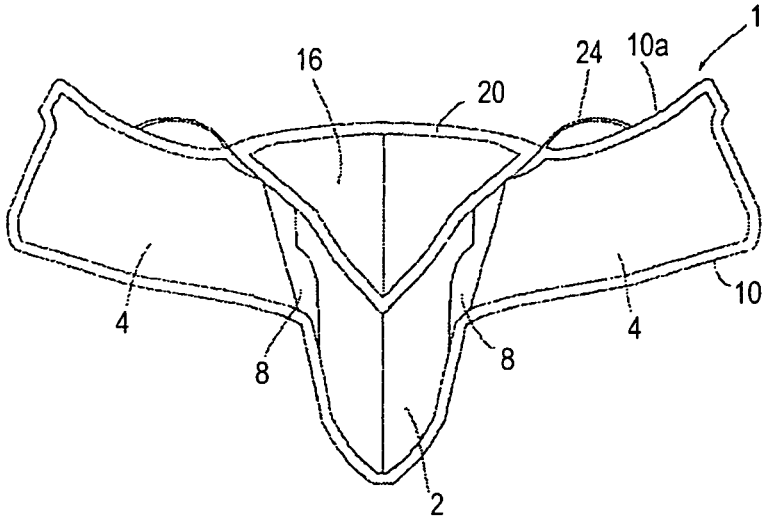
FIG. 4 shows a front side view of a face mask according to second embodiment of the present invention.
Figure 5:
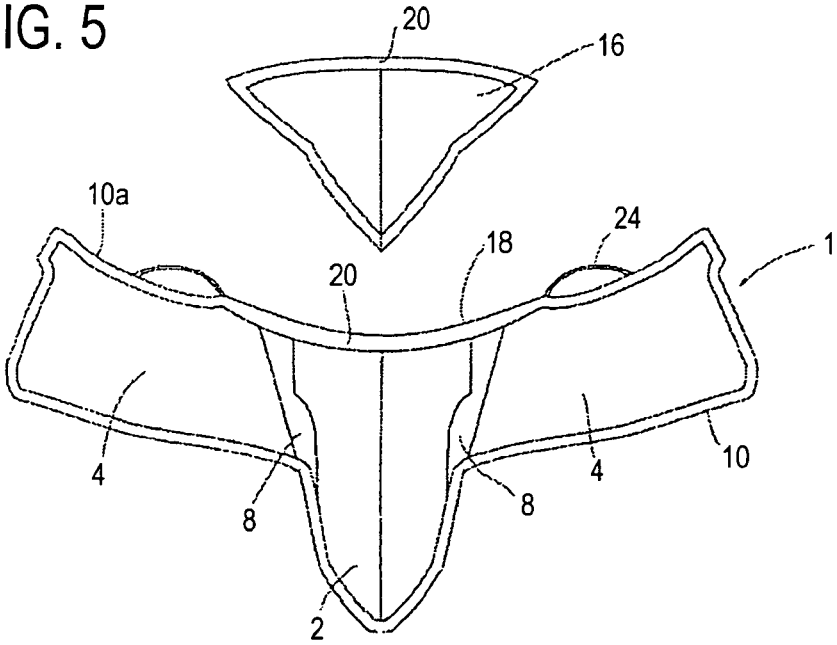
FIG. 5 shows the face mask shown in FIG. 4 in a dissolved state.
Figure 6:
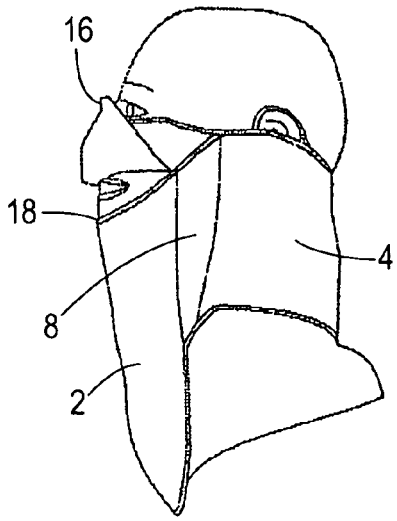
FIG. 6 shows how to use the face mask shown in FIG. 4.

FIGS. 4 to 6 show the second embodiment of the present invention. In this embodiment, the main mask body 1 has an upper side 12 with a downwardly recessed part 18 through which user's mouth appears outwards. The recessed part extends from the first cloth-like piece 2 through the connecting piece to a base (front part) of the second cloth-like piece.

Moreover, a spanning linear member 20 is bridged over the both ends of the recessed part 18 at its upper edge. And also, a third cloth-like piece 16 is hung from the spanning linear member 20 to the outside of the first cloth-like piece. The third cloth-like piece 16 covers the recessed part 18 and its neighboring cloth portions for keeping warm at the mouth. The third cloth-like piece may be turned over as shown in FIG. 6 to expose the mouth outside. In this embodiment, the spanning linear member 20 and the portion of the upper edge member excluding the recessed part function as a fastening band for resting on the wearer's face. Moreover, an ear-hook band 24 is provided at the upper end of the second cloth-like piece 4.

Figure 7:
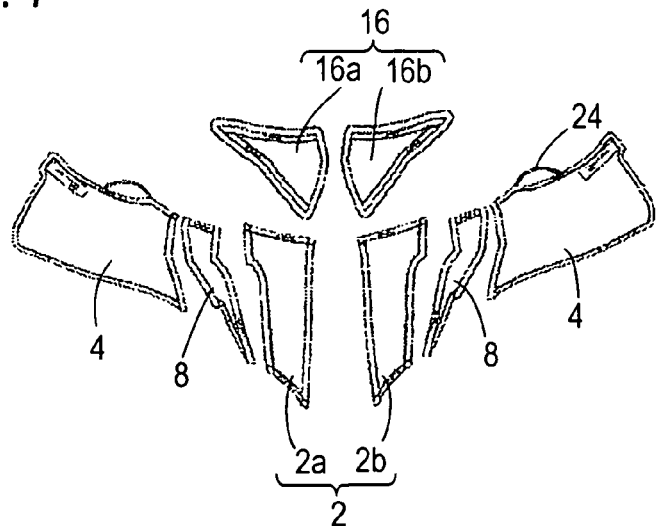
FIG. 7 shows a variation of the face mask shown in FIG. 4 in a dissolved state.

FIG. 7 shows one example of the face mask according to the second embodiment. In this example, the first cloth-like piece 2 is made of a pair of left and right parts 2*a*, 2*b*, and the third cloth-like piece 16 is made of pair of left and right parts 16*a*, 16*b*, such that the face mask has a three dimensional configuration which meets the profile of user's face.

I claim:

1. A face mask comprising a first thin piece which is flexible, soft, and spreadable and adapted to cover at least from beneath a nose to a jaw of a user's head, a pair of second thin pieces which are flexible, soft, and spreadable and adapted to extend from cheeks to a back of the user's head, a pair of thin connecting pieces which are flexible, soft, and spreadable and elastically stretchable for connecting both left and right sides of the first thin piece and corresponding ends of the second thin pieces, each of the second thin pieces having a leading portion for mutual connection at the back of the user's head, wherein:

the first thin piece and the second thin pieces are harder to stretch elastically than the connecting pieces, the face mask is further provided at its upper end with an upper edge member extending from the connecting piece to at least adjacent parts of the first thin piece and the second thin pieces, the upper edge member is harder to stretch elastically than the connecting pieces, the face mask has an upper side which is defined by respective upper ends of the first thin piece and the connecting pieces and the second thin pieces, and the upper side is straight or gently arched, and the upper edge member extends continuously along the upper side to function as a fastening band for putting the face mask on a user's face.

2. The face mask according to claim 1, wherein a pair of ear-hook bands are provided at the upper ends of the second thin pieces.

3. The face mask according to claim 1, wherein the face mask has the upper side which is defined by the respective upper ends of the first thin piece and the connecting pieces and the second thin pieces, the upper side is as a whole straight or gently arched, but curved downwardly around the first thin piece to form a recessed part when the face mask is attached to the user's head, the face mask further comprises a spanning linear member which is provided between both ends of the recessed part also serving as an edge of the mask, and a third thin piece which is depending from the spanning linear member over the first thin piece so as to cover the recessed part, the recessed part is so sized that a mouth of the user appears in the recessed part when the spanning linear member rests on the nose of the user and the third thin piece is turned over, and the upper edge member ranges over the respective upper ends of the first and second thin pieces and the connecting piece, such that a portion of the upper edge member excluding a depressed part and the spanning linear member function as a single suspension band for putting on a user's face.

* * * * *